313-414 SR
6/9/87 OR 4,672,261

United States Patent [19]
Shirai et al.

[11] Patent Number: 4,672,261
[45] Date of Patent: Jun. 9, 1987

[54] ELECTRON GUN FOR COLOR PICTURE TUBE

[75] Inventors: Shoji Shirai, Koganei; Fumio Noda; Yoshiaki Iidaka, both of Chiba; Masaaki Yamauchi, Togane; Masakazu Fukushima, Tokyo, all of Japan

[73] Assignees: Hitachi, Ltd., Tokyo; Hitachi Device Engineering Co., Ltd., Chiba, both of Japan

[21] Appl. No.: 760,150

[22] Filed: Jul. 29, 1985

[30] Foreign Application Priority Data

Jul. 27, 1984 [JP] Japan ..... 59-155300

[51] Int. Cl.[4] ..... H01J 29/62
[52] U.S. Cl. ..... 313/414; 313/449
[58] Field of Search ..... 313/414, 412, 413, 449

[56] References Cited

U.S. PATENT DOCUMENTS 3,678,316 7/1972 Barten ..... 313/414 X
3,922,580 11/1975 Hutter ..... 313/449 X
4,581,560 4/1986 Shirai et al. ..... 313/414

FOREIGN PATENT DOCUMENTS 31805 10/1981 Japan .
86735 5/1985 Japan .
79647 7/1985 Japan .
1048533 10/1983 U.S.S.R. .

*Primary Examiner*—Palmer C. DeMeo
*Attorney, Agent, or Firm*—Antonelli, Terry & Wands

[57] ABSTRACT

An inline electron gun for color picture tube comprises a main lens including a plurality of electrodes spaced apart to each other and each of these electrodes has a pheripheral rim. Two of these peripheral rims oppose to each other and at least one of the peripheral rims has such an uneven shape that focusing force for the electron beams is increased.

34 Claims, 16 Drawing Figures

ELECTRON GUN FOR COLOR PICTURE TUBE

BACKGROUND OF THE INVENTION

This invention relates to an electron gun for a color picture tube, and in particular to the structure of electrodes constituting a main lens.

The spherical aberration of the main lens is enumerated among various factors, which influence remarkably the resolving characteristics of a color picture tube. It is known that the enlargement of the diameter of the electrodes constituting the main lens is efficacious for reducing the spherical aberration of the main lens.

However, for an inline electron gun since the circular cylindrical main lenses corresponding to three colors of R, G and B are arranged in one same horizontal plane, in a glass envelope, the diameter of the aperture should be smaller than $\frac{1}{3}$ of the inner diameter of the neck portion containing the electron gun. By giving the thickness of the electrodes careful consideration and further by paying attention to the problematical points on the fabrication of the electrodes, this limit value is further decreased. If the inner diameter of the neck portion is increased, in order to raise this limit value, electric power for deflection increases. Moreover, in general, if the aperture is enlarged, the distance between the central axes of the beams becomes greater with increasing distance from the center of the beam which gives rise to worsening of convergence characteristics. Usually, since the diameter of the aperture is so designed that it is as large as possible while giving these points considerations, it is extremely difficult to further enlarge it.

U.S. Pat. No. 4,370,592 and 4,429,252 have proposed examples of non-circular cylindrical main lenses permitting effective enlargement of the aperture diameter beyond the above-mentioned limit value. The main lens disclosed in these patent specifications comprises two electrodes, each of which has an electrode plate provided with three apertures. Each of these electrode plates is disposed within a recess set back from the peripheral rim of the electrodes. Due to this arrangement, the electrostatic field produced by the counter electrode penetrates deeply into the interior of the electrode plate, gives rise to the same effect as the increase in the diameter of the aperture.

However, since the horizontal diameter of the cross-section of the peripheral portion of the electrode is greater than the vertical diameter thereof, the penetration of the electrostatic field is remarkable in the horizontal direction. Due to this fact, the focusing force of the lens in the horizontal direction is weaker than that in the vertical direction and thus astigmatism is produced in the electron beam. In order to correct this astigmatism, U.S. patent application Ser. No. 448,601 filed on Dec. 10, 1982, now U.S. Pat. No. 4,581,560, has proposed that the aperture is formed to be non-circular in such a manner that the aperture diameter in the horizontal direction is smaller than that in the vertical direction. In this way, the astignatism can be removed by strengthening the focusing electric field in the horizontal cross-section and by balancing the focusing forces in the horizontal and vertical directions.

When the angle of incidence of the electron beam to the electrode and the spread of the beam in the main lens are small, the astigmatism can be removed in this manner. However, when the beam spread is large, electrons pass in the neighborhood of the rim portion of the aperture in both the electrode plates. In this neighborhood, since the intensity of the electric field is high, the focusing force in the horizontal direction is stronger than that in the vertical direction. As the result, the point where electrons are focused in the horizontal direction is farther in front of the screen than that in the vertical direction. Consequently the diameter of the beam spot on the screen in the horizontal direction is greater than that in the vertical direction and thus the resolving power in the horizontal direction is reduced.

Further, these phenomena are more remarkable with decreasing distance between the axes of the beams. The reason therefor is the decrease of the horizontal diameter of the aperture. Therefore, there is a limit to the decrease of the distance between the axes of the beams for the purpose of ameliorating the convergence characteristics. When the diameter of the neck portion of the glass envelope is 29 mm, this limit is approximately 5.5 mm.

SUMMARY OF THE INVENTION

This invention has been developed in consideration of these points with the object of providing an electron gun permitting enlargement of the aperture without reducing resolving power in the horizontal direction.

In order to achieve this object, this invention is characterized in that the main lens is composed of a plurality of electrodes spaced apart with a certain distance to each other and that at least one of the peripheral rims of two adjacent electrodes has an uneven shape so that focusing force for each electron beam is increased in a specified direction. That is, on the basis of the knowledge of the inventors of this invention that the worsening of the resolving power in the horizontal direction by the conventional non-circular cylindrical lens having a large aperture can be attributed to the fact that the electrode plates for correcting the astigmatism are disposed in the interior of the peripheral electrode, it is proposed to remove these electrode plates and at the same time to correct the astigmatism in the horizontal direction provoked thereby by forming the peripheral rims of the electrodes constituting the main lens in an uneven shape.

DESCRIPTION OF THE PREFERRED EMBODIMENTS

Figure 1:
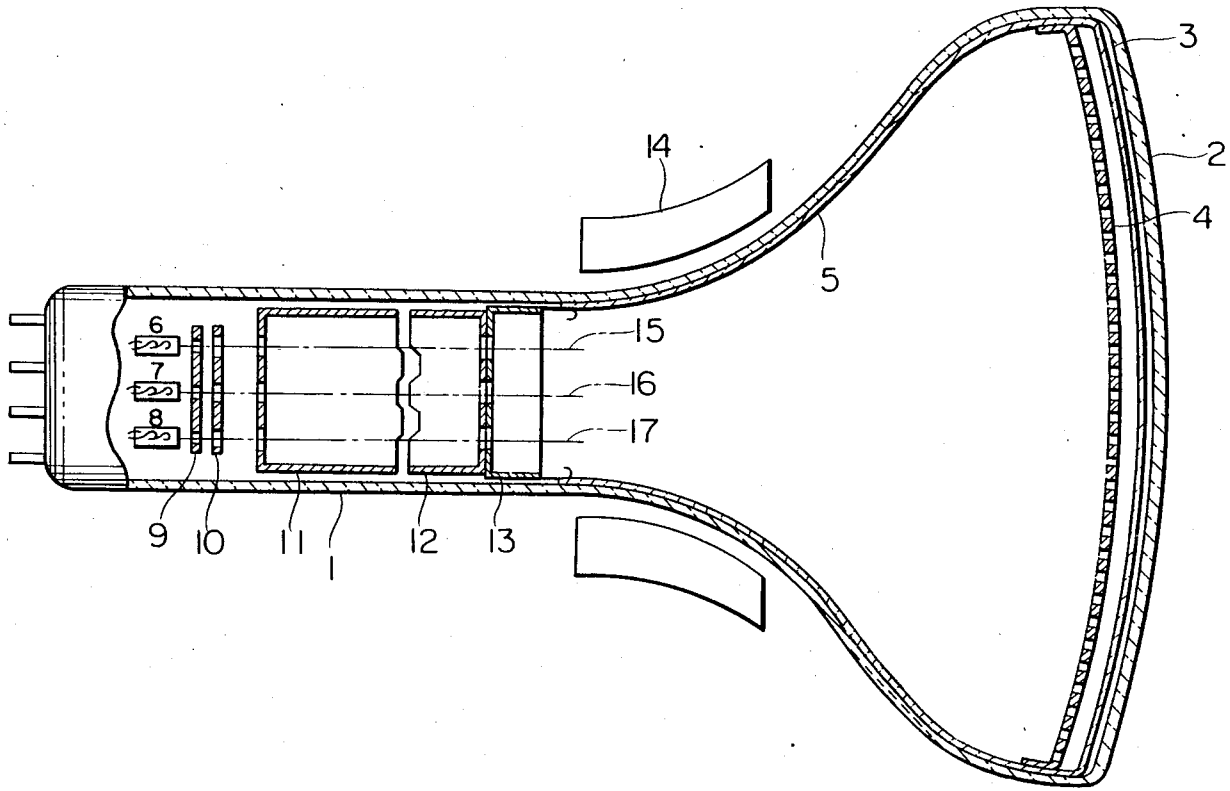
FIG. 1 is a cross-sectional view showing the outline of an inline color picture tube according to this invention.

FIG. 1 is a partly cross-sectional plane view of an inline type color picture tube provided with an electron gun according to this invention. A fluorescent screen 3, on which 3 color phosphors are applied alternately in a stripe shape, is attached to the inner surface of the face plate 2 of a glass envelope 1. Electron beams starting from cathodes 6, 7, 8 pass through apertures formed in a G1 electrodes 9 and a G2 electrode 10, corresponding to these cathodes, respectively, and emerge along the axes 15, 16, 17 of the beams, respectively. The central axes of the cathodes 6, 7, 8 and those of the apertures formed in the G1 electrode 9 and the G2 electrode 10 coincide with those of the electron beams 15, 16, 17, respectively and these are substantially parallel to each other on a common plane. A direction on this common plane is called a horizontal direction and the direction perpendicular to this common plane on a plane passing through the axis of each of the beams is called the vertical direction.

The three electron beams passing through the apertures formed in the G2 electrode 10 enter the main lens consisting of a G3 electrode 11 and a G4 electrode 12. The G3 electrode 11 is set to a potential lower than that of the G4 electrode 12 and the latter is at a same potential as a shield cup 13 and the conductive coating 5 applied on the inner surface of the glass envelope 1. Each of the 3 electron beams is focused by the main lens on the shadow mask 4. In this case, the 3 electron beams must be converged in one point and this operation is called static convergence (STC). The electron-beams focused on the shadow mask 4 are selected in color by the shadow mask 4 and only the component exciting and making radiate one of the phosphors of a color corresponding to each of the beams passes through a hole to reach the fluorescent screen. Further, an external magnetic deflection yoke 14 is disposed for scanning the fluorescent screen with the electron beams.

Hereinbelow the construction of the electrodes constituting the main lens, which is the principal part of this invention, will be explained more in detail.

Figure 2:
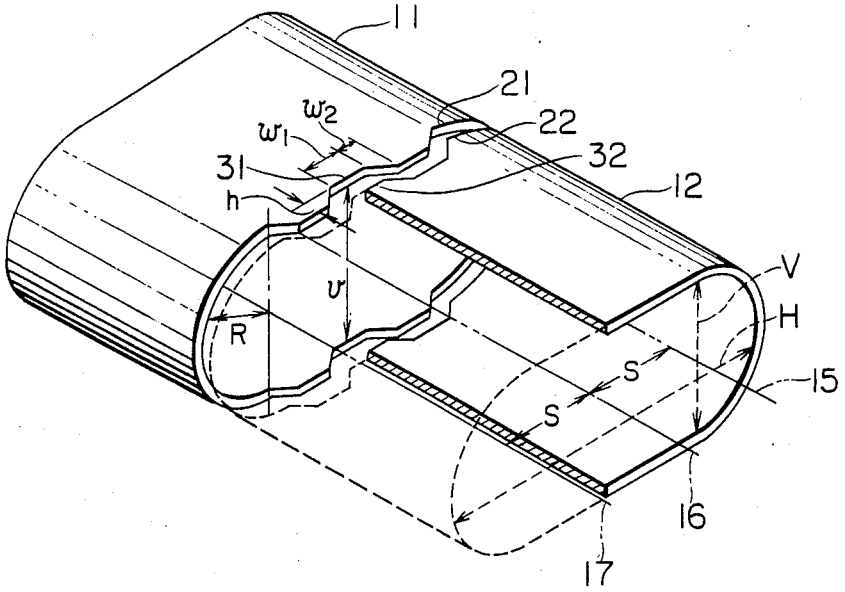
FIG. 2 is a perspective view showing an embodiment of the main lens for the electron gun partly broken according to this invention.

FIG. 2 is a perspective view showing an embodiment of the main lens for the electron gun partly broken according to this invention. As indicated in the figure, each of the G3 electrode 11 and the G4 electrode 12 consists of a non-circular cylindrical hollow electrode, whose inner diameter H in the plane comprising the central axes of the electron beams is greater than the inner diameter V in a plane perpendicular to the central axes and the peripheral rims 21, 22 of the electrodes opposing to each other are formed in an uneven shape so that they are complementary to each other. In this figure, concave parts 31 are formed at the peripheral rim 21 of the electrode, whose potential is lower, and convex parts 32 at the peripheral rim 22 of the electrode, whose potential is higher. These concave and convex parts 31, 32 are disposed at the intersections of the peripheral rims and the plane, which is perpendicular to the plane containing the central axes of the electron beams and passes through the central axis of the electron beam, which is at the center among the electron beams.

Figure 3:
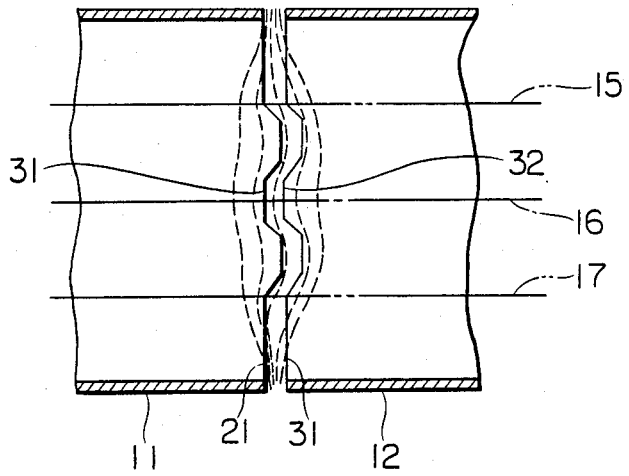
FIG. 3 is a cross-sectional view in the horizontal plane passing through the center line of the embodiment illustrated in FIG. 2.

FIG. 3 illustrates a cross-sectional view in the horizontal plane passing through the center line of the main lens indicated in FIG. 2 and the distribution of equipotential lines on the plane in a schematic manner. In FIG. 3 it can be understood that the equi-potential lines indicated in broken line undulate along the uneven shape of the peripheral rims of the electrodes and that they bend around each of the central axes 15, 16, 17 of the electron beams so that they are convex towards the G3 electrode 11. Since this bending is stronger than that obtained when the peripheral rims 21, 22 of the electrodes have an even shape, electric the field in the horizontal radial direction producing a focusing force for each of the beams is strengthened on the horizontal cross-section and the horizontal focusing force balances with the vertical one. When the focusing forces in both the directions balance with each other, it is possible to remove the astigmatism. The diameter of the effective aperture of this main lens agrees approximately with that in the vertical direction and thus enlargement of the aperture is achieved. In this case, the G3 electrode 11 and the G4 electrode 12 are hollow and they have no electrode plates, with which the prior art electron gun is provided. Therefore no worsening of the resolving power in the horizontal direction is produced.

A concrete example of dimensions for the embodiment illustrated in FIG. 2 will be indicated below.

| | |
|---|---|
| Distance between the axes of two adjacent electron beams; | s = 5.1 mm |
| Diameter in the vertical direction of the electrodes 11, 12; | v = 9.0 mm |
| Radius of the semicircles at both the sides of the electrodes 11, 12; | R = 4.5 mm |
| Dimensions of the concave part 31 of the peripheral rim 21 of the electrode 11; | w1 = 6.0 mm<br>w2 = 2.0 mm<br>h = 1.7 mm |

The dimensions of the convex part 32 of the peripheral rim of the G4 electrode 12 are identical to those of the concave part 31 of the G3 electrode 11 corresponding thereto. The cross-section of the G3 electrode 11 and the G4 electrode 12 has the shape of a running track, where the radius of the two semi-circular ends is R.

Figure 4:
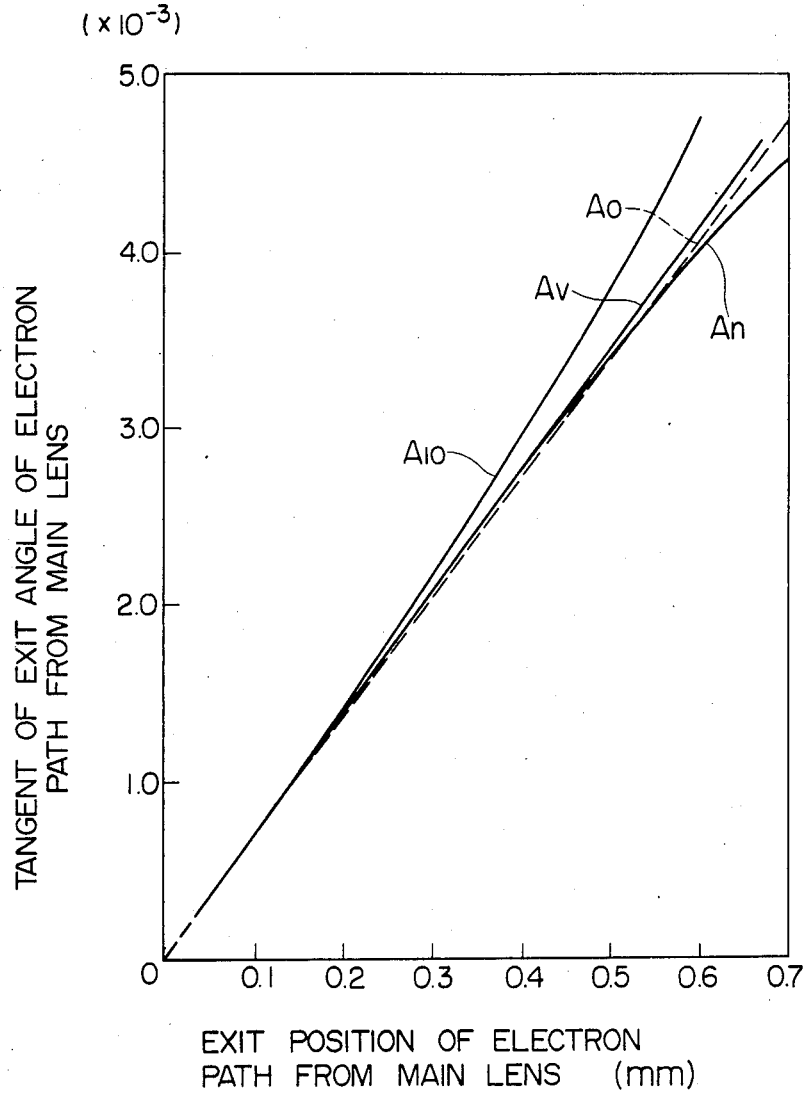
FIG. 4 is a diagram showing aberration characteristics of the main lens of the embodiment illustrated in FIG. 2.

The distance s between the axes of two adjacent electron beams is smaller than the limit for the prior art large aperture non-circular cylindrical lens stated above, which is 5.5 mm. Consequently it can be expected also to ameliorate the convergence characteristics. FIG. 4 indicate beam exit characteristics for the center beam entering the main lens of this embodiment. In FIG. 4, the ordinate separates the tangent of the exit angle of the electron path and the abscissa the exit position of the electron path. If the tangent of the exit angle and the exit position were proportional to each other and the relationship between them could be represented by a straight line in a cartesian coordinate, all the electrons would pass through a point and the aberration would be zero. The straight line representing this zero aberration is shown by a broken line $A_0$ in FIG. 4. The farther away the curve representing the relationship between the tangent of the exit angle and the exit position from this straight line $A_0$ is, the greater the abberation is.

FIG. 4 shows aberration characteristics for electrons starting from a point on the central axis and entering a circular cylindrical lens, whose diameter is 10 mm, $A_{10}$, and horizontal aberration characteristics $A_n$ and vertical aberration chracteristics $A_v$ representing the relationship between the exit position and the tangent of the exit angle for electrons starting from a point on the central axis and entering the main lens stated in the embodiment shown in FIG. 2 along the horizontal and vertical cross-sections, respectively. When the exit position is near the central axis (i.e. the beam is paraxial), these 3 sorts of curves are superposed on each other. Consequently the focusing points of these paraxial beams are identical and it can be understood that the main lens having the electrode structure indicated in FIG. 2 gives rise to no astigmatism.

Further, when the exit position is apart from the central axis, the curve $A_{10}$ representing aberration charactersitics of a circular cylindrical lens, whose diameter is 10 mm, deviates from the straight line $A_0$ representing zero aberration and the magnitude of its disaccordance is greater than that of the aberration characteristic curves $A_h$ and $A_v$ for the main lens indicated in FIG. 2. This means that the aberration characteristics of the main lens according to this invention are better than those of the circular cylindrical lens, whose aperture is enlarged to 10 mm. In this case, since the distance s between the central axes of two adjacent electron beams is 5.1 mm, when the main lens is constituted by a cylindrical lens, the maximum diameter of the effective aperture is enlarged more than twice and remarkable amelioration of spot characteristics can be realized.

Further, in FIG. 4, the curve $A_h$ representing the horizontal aberration characteristics deviates downward from the straight line $A_0$ representing zero aberration. This means that negative spherical aberration is produced in the horizontal direction and that there exists a possibility to ameliorate spot characteristics by compensating with each other this negative spherical aberration and the positive spherical aberration produced by the cathode lens and the pre-focus lens consisting of cathode—G1 electrode—G2 electrode—B3 electrode.

In this way the diameter of the aperture of the main lens in the embodiment indicated in FIG. 2 is much greater than the upper limit for the cylindrical lens. In addition, the horizontal aberration characteristics are not worsened with respect to those in the vertical direction.

FIGS. 5 to 12 show other various embodiments according to this invention.

Figure 5:
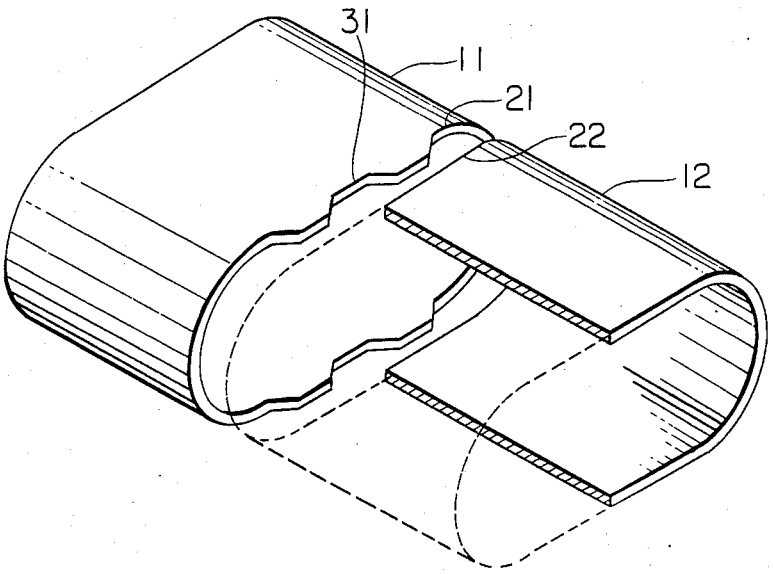
FIGS. 5 to 13 are perspective views showing other various embodiments partly broken according to this invention.
Figure 6:
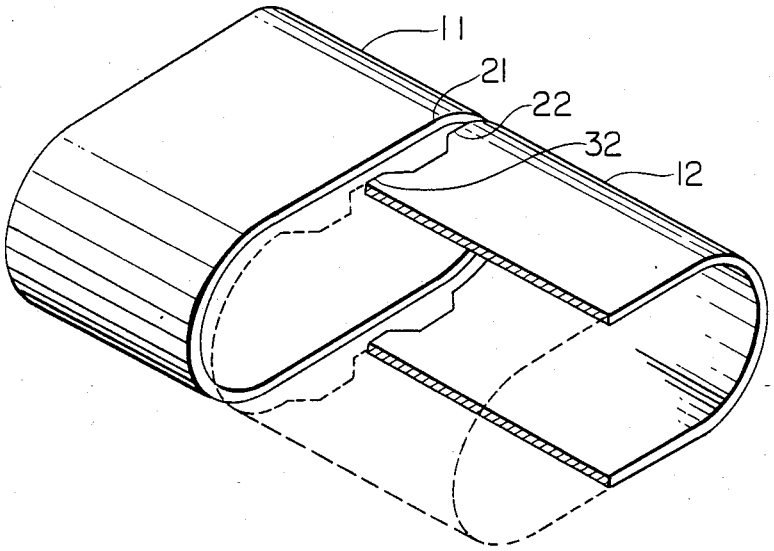

FIGS. 5 and 6 shows embodiments in which either one of the peripheral rims 21, 22 of the electrode 11, 12 has an even shape. The embodiment indicated in FIG. 5 has concave parts 31 and no convex parts 32. To the contrary that indicated in FIG. 6 has no concave parts 31, but convex parts 32. In both the cases, the peripheral rim 21 or 22 opposing to that having the even shape has an uneven shape so that focusing force in the horizontal direction for the electron beams is increased and thus the astigmatism can be removed.

Figure 7:
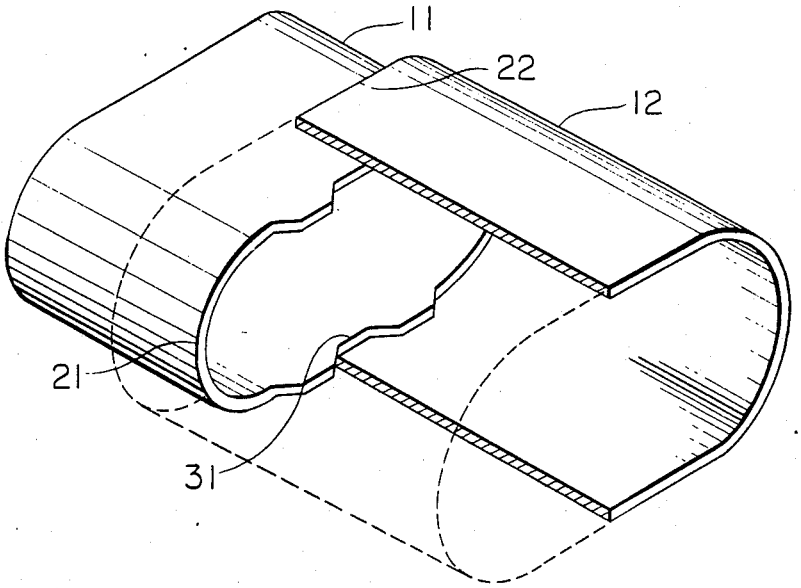
Figure 8:
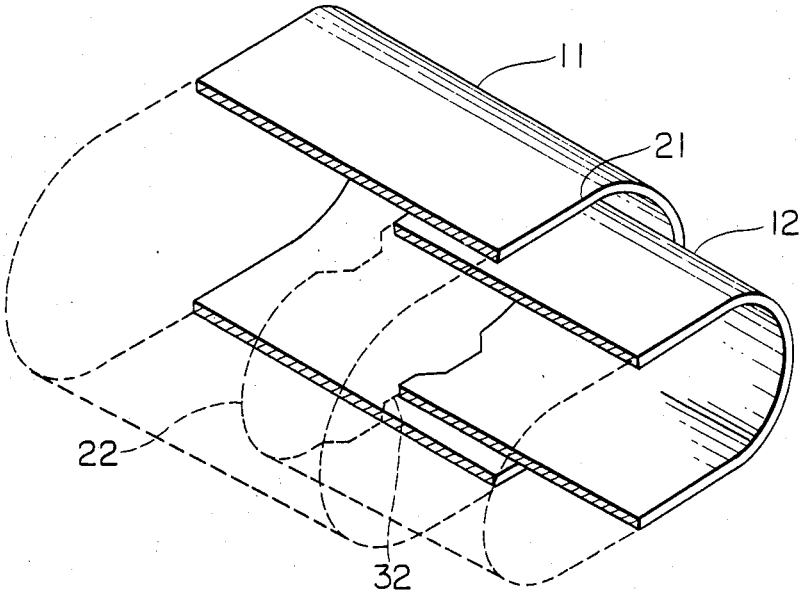

FIGS. 7 and 8 shows embodiments, in which the peripheral rim 22 or 21 of one of the electrodes, 12 or 11, has the even shape, the aperture of the electrode being greater than the other, and the electrode covers at least the rim portion of the other electrode 11 or 12 adjacent thereto. This structure has an advantage that since the electron beam path is convered perfectly by the electrode 12 or 11, the electron beam is not influenced from the outside.

In general, in the structure of the main lens, which has been used for the electron gun for color picture tube, a problem of STC drift is provoked. This is a phenomenon that the potential on the inner surface of the glass envelope 1 varies in time and this potential variation influences the outer electron beam path through the gap between two adjacent electrodes so that STC can be no more realized. In the embodiments illustrated in FIGS. 7 and 8, since the electron beam path is not influenced by the potential on the inner surface of the glass envelope, no problem of STC drift in the main lens is provoked.

Figure 9:
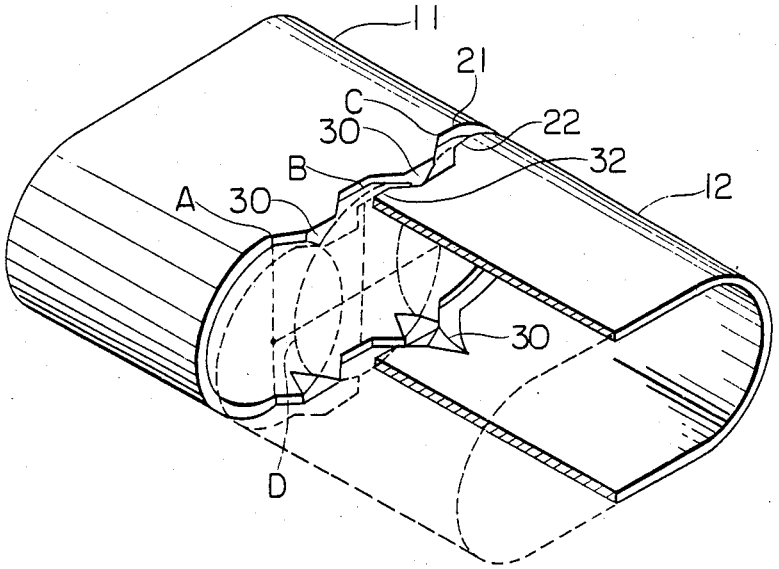
Figure 10:
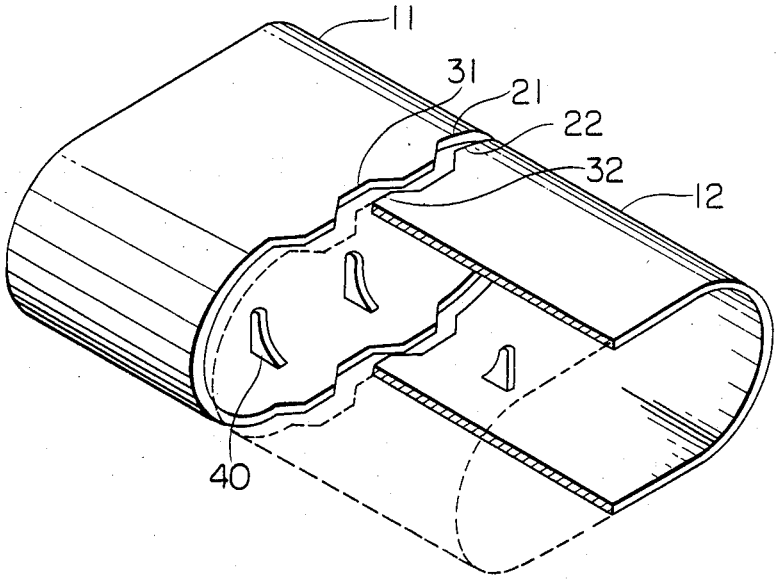

FIGS. 9 and 10 shows two examples of the structure of electrodes constituting the main lens enabling that focusing forces in any directions other than the horizontal and vertical directions agrees with each other and that a beam spot shape further closer to a true circle is obtained. In the embodiments described above, although the focusing forces in the vertical and horizontal directions can agree with each other, focusing forces in oblique directions do not, and thus the beam spot shape is no more truly circular. In order to adjust focusing forces in oblique directions, in the embodiment illustrated in FIG. 9, protrusions 30 are formed at the inner side of the electrodes in the middle portions between two adjacent points among three points A, B, C at which the peripheral rim intersects the three planes perpendicular to the plane containing the central axes of a plurality of electron beams, each of which passes through each of the central axes. These protrusions 30 are so formed that the magnitude of the projection is greatest on the vertical planes containing the middle lines between the axes of the electron beams. The contour of each of the protrusions consists preferably of two arcs of two circles, whose centers are on the central axes of two adjacent electron beams, as indicated by broken lines D in FIG. 9.

On the other hand, in the embodiment illustrated in FIG. 10, protrusions 40 are formed at locations retreated with a certain distance towards the interior of each of the electrodes. In both the cases, electric fields in oblique directions are strengthened so that an electron beam shape close to a true circle can be obtained.

Figure 11:
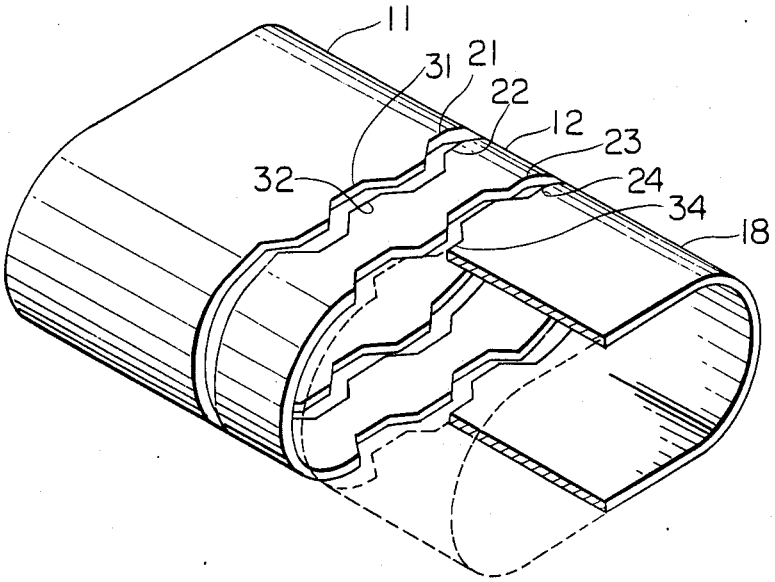
Figure 12:
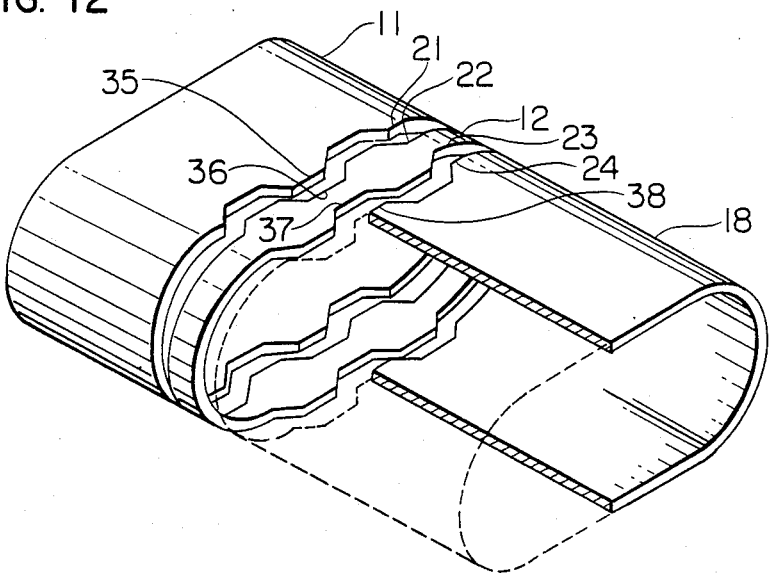
Figure 13:
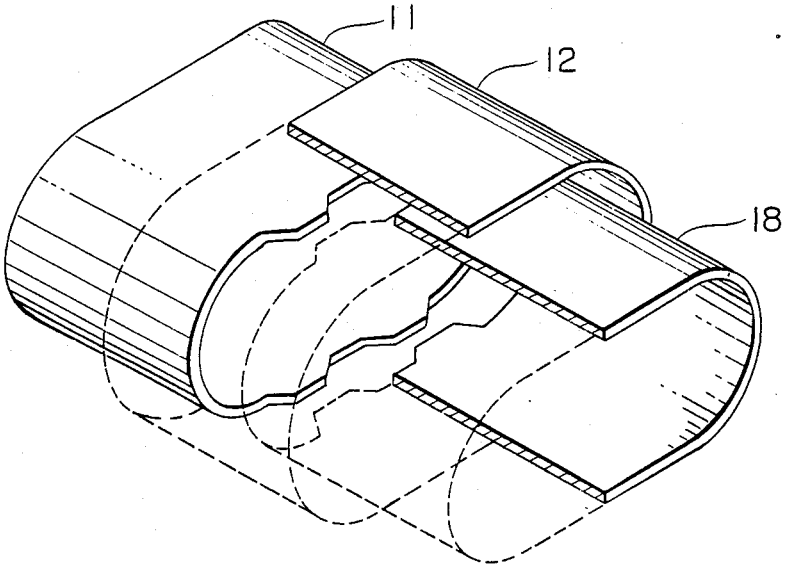

FIGS. 11, 12 and 13 shows embodiments, in which this invention is applied to uni-potential focusing (UPF) lenses.

In the embodiment illustrated in FIG. 11, a high potential G4 electrode 12 is disposed between a low potential G3 electrode 11 and another low potential G5 electrode 18. To the contrary, in the embodiment illustrated in FIG. 12, the G4 electrode is at a low potential and the G3 and G5 electrodes are at a high potential. In both the embodiments, as in the embodiment illustrated in FIG. 2, the peripheral rims 21, 22, 23, 24 opposing to each other of the high and low potential electrodes comprise concave parts 31, 34 or 36, 37 and convex parts 32, 34 or 35, 38 having such a bent structure that the magnitude of retreat and projection, respectively, is greatest at the locations, where the peripheral rims intersect the three planes perpendicular to the plane containing the central axes of the electron beams, each of which passes through each of the central axes. This uneven shape strengthens focusing force in the horizontal direction and thus can remove the stigmatism.

In the embodiment illustrated in FIG. 13, a high potential outer electrode 12 covers the portion adjacent to the gap of two low potential electrodes 11, 18 opposing to each other. Just as in the embodiment illustrated in FIGS. 7 and 8, since the electron beam path is not influenced by potential variations on the inner surface of the glass envelope, this embodiment has an advantage that no problem of static convergence (STC) drift in the main lens is provoked.

Figure 14:
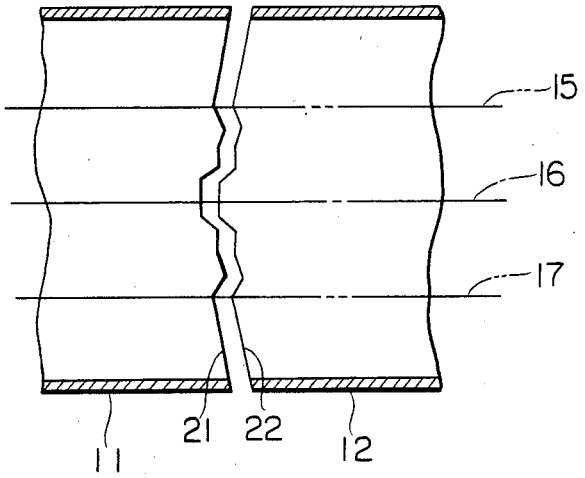
FIGS. 14 to 16 are cross-sectional views in the horizontal plane passing through the center line of other various embodiments according to this invention, where static convergence is realized.

Various methods for realizing STC can be used in the structure of the main lens for an electron gun according to this invention. The first method consists in that the main lens formed at the outer sides and focusing the side beams is inclined. FIG. 14 shows a horizontal cross-sectional view of an embodiment to which this method is applied. When this figure is compared with the cross-section indicated in FIG. 3, it is seen that, although the structures near the central axis 16 of the center beam are identical, the peripheral rims 21, 22 of the electrodes near the central axes 15, 17 of both the side beams are inclined. That is, the outermost portions of the peripheral rim 21 of the low potential electrode 11 protrude and the outermost portions of the peripheral rim 22 of the high potential electrode 12 retreat at a slope. The side beams are subjected to focusing force and at the same time to deflecting force towards the center beam. In this manner the 3 electron beams can be concentrated at one point on the shadow mask and thus STC is realized.

Figure 15:
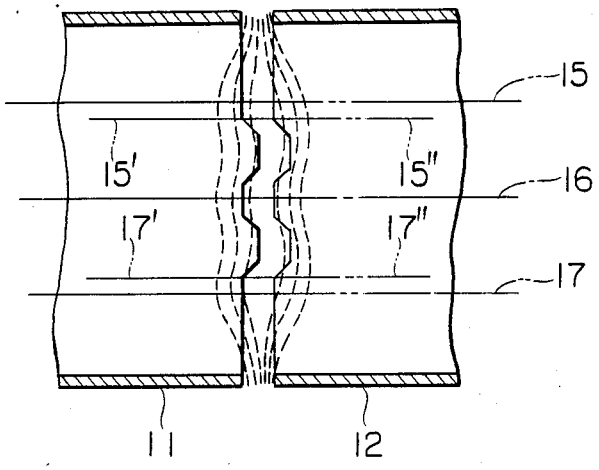
Figure 16:
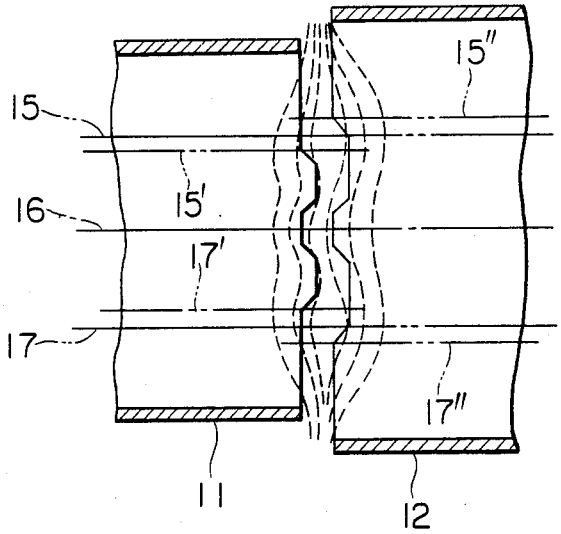

The second method for realizing STC consists in that the axes of the lenses formed at both the sides among the lenses formed at the center and at the sides are shifted from the central axes of the paths of the side beams. FIGS. 15 and 16 are cross-sectional views in the horizontal plane passing through the center lines of two different embodiments according to this method and the form and the distribution of equi-potential lines therein in a schematical manner. In FIG. 15, the lens central axes 15' and 17' formed at both the sides of the G3 electrode 11, which is at a low potential, coincide with the lens central axes 15'' and 17'' formed at both the sides of the G4 electrode 12 and they are shifted towards the inner sides with respect to the central axes 15 and 17, respectively, of the side beams. Consequently the side beams pass through the outer parts of both the side lenses and the side beams are subjected to deflecting force towards the center beam due to the focussing force of the lenses so that STC can be realized. In this case, the converging effect within the G3 electrode 11 overcomes the diverging effect within the G4 electrode 12 and the beams are subjected finally to converging force. In addition, in the case where the cross-sections of the electrodes have semi-circular parts at both the sides, the lens central axes coincide with the axes passing through the centers of these semi-circules.

In the embodiment illustrated in FIG. 16, the lens central axes 15'' and 17'' formed at both the sides within the G4 electrode are shifted outward with respect to the central axes 15 and 17 of the side beams, respectively, contrarily to the shifts of the axes within the G3 electrode in order that the side beams are further subjected to deflecting force towards the center beam not only within the G3 electrode 11 but also in the diverging lens region within the G4 electrode 14. For this this reason, this embodiment has an advantage that STC can be realized even for small shifts of the axes, because the side beams pass through the outer sides of the converging lens within the G3 electrode as well as the inner sides of the diverging lens within the G4 electrode so that they are subjected to deflecting force towards the center beam in both the regions.

Furthermore, in the embodiment illustrated in FIG. 16, even if 15' and 17' coincide with 15 and 17, respectively, or 15'' and 17'' coincide with 15 and 17, respectively, STC can be realized, because the side beams are subjected to deflecting force towards the center beam within the G4 electrode or the G3 electrode.

In addition, in FIGS. 2 to 16 illustrating embodiments of this invention, although the uneven shape of the peripheral rims opposing to each other of the electrodes is trapezoidal, various shapes can be applied therefor such as combinations of arcs, triangles, and so forth.

Further, according to this invention, the main lens can be of multi-stage type, obtained by combining a plurality of uni-potential focusing (UPF) lenses and bipotential focusing (BPF) lenses. In this structure conventional cylindrical main lenses can be also used.

As explained above, according to this invention, since the main lens of an electron gun is constituted only by electrodes having no electrode plate, the diameter of the effective apperture of the main lens can be enlarged to the diameter in the vertical direction of the electrodes and thus enlargement of the aperture is achieved. In this case curvature of equi-potential lines in the horizontal plane is strengthened and focusing force in the horizontal direction can be increased to that in the vertical direction so that the astigmatism is removed, by forming the peripheral rims opposing to each other of a pair of electrodes constituting the main lens in an uneven shape. Since there are no electrode plates within the electrodes, aberration characteristics in the horizontal direction is not worsened. Consequently it is possible to reduce the distance between the axes of electron beam to a smaller value than before and to ameliorate convergence characteristics.

Although in the above this invention has been explained, referring to an electron gun for color picture tube converging a plurality of electron beams, in the specification, this invention can be applied also to the main lens of an electron gun converging only one electron beam.

When a main lens having the structure illustrated in FIG. 2 is used as the main lens of an electron gun generating and converging only one beam, the same characteristics as indicated in FIG. 4 can be obtained and thus it is possible to ameliorate the characteristics.

In the manner described above, according to this invention, resolving power can be increased for electron tubes, such as mono-color picture tubes using a single electron beam, projection cathode-ray tubes, observation tubes image pickup tubes, etc.

What is claimed is:

1. An inline electron gun for a color picture tube which generates a plurality of electron beams and directs them towards a fluorescent screen, comprising a main electrostatic lens for focusing said electron beams, said main electrostatic lens including a plurality of non-circular cylindrical electrodes which oppose each other at a certain distance and each of which has a cross-section such that the inner dimension in a first direction is in a first plane containing the central axes of said electron beams and is perpendicular to the central axes of said electron beams, is greater than the inner dimension in a second direction which is in a second plane perpendicular to said first plane and is perpendicular to said direction, said electrodes having respective peripheral rims which face each other, and the peripheral rim of at least one of said opposing electrodes having such an uneven shape that a focusing force for the electron beams is increased in said first direction.

2. An inline electron gun for a color picture tube according to claim 1, wherein the peripheral rim of one of said opposing electrodes, which is to be at a lower potential, has said uneven shape formed of concave parts disposed at the intersections of said peripheral rim and a plane which is perpendicular to said first plane and passes through the central axis of one of said electron beams which is at the center thereamong.

3. An inline electron gun for a color picture tube according to claim 1, wherein the peripheral rim of one of said opposing electrodes, which is to be at a higher potential, has said uneven shape formed of convex parts disposed at the intersections of said peripheral rim and a plane which is perpendicular to said first plane and passes through the central axis of one of said electron beams which is at the center thereamong.

4. An inline electron gun for a color picture tube according to claim 1, wherein the respective peripheral rims of said opposing electrodes have said uneven shapes which are complementary to each other.

5. An inline electron gun for a color picture tube according to claim 1, wherein the number of said electron beams is three protrusions are formed at middle portions between two adjacent ones among three points at which the peripheral rim of said at least one electrode intersect three planes which are perpendicular to said first plane and pass through the central axes of said three electron beams.

6. An inline electron gun for a color picture tube according to claim 1, wherein the number of said electron beams is three and protrusions are formed at locations retreated with a certain distance towards the interior of said at least one electrode from middle portions between two adjacent points at which the peripheral rim of said at least one electrode intersect three planes which are perpendicular to said first plane and pass through the central axes of said three electron beams.

7. An inline electron gun for a color picture tube according to claim 5, wherein the contour of each of said protrusions includes two arcs of two circles whose centers are on the central axes of two adjacent ones of said three electron beams.

8. An inline electron gun for a color picture tube according to claim 1, wherein the outermost portions of said peripheral rims of said opposing electrodes protrude for one of said electrodes, which is to be at a lower potential, and retreat for the other of said electrodes, which is to be at a higher potential, at a slope.

9. An inline electron gun for a color picture tube according to claim 1, wherein the outermost portions of the peripheral rims of said electrodes opposite to each other in said first direction are semi-circular.

10. An inline electron gun for a color picture tube according to claim 1, wherein the number of said electron beams is three and the central axes of the lenses formed at both the sides of one of said opposing electrodes, which is to be at a lower potential, are shifted inward with respect to the central axes of two outer beams among said three electron beams.

11. An inline electron gun for a color picture tube according to claim 9, wherein the number of said electron beams is three and the central axes of the lenses formed at both the sides of one of said opposing electrodes, which is to be at a higher potential, are shifted outward with respect to the central axes of two outer beams among said three electron beams.

12. An inline electron gun for a color picture tube according to claim 11, wherein the central axes of the lenses formed at both the sides of the other of said opposing electrodes, which is to be at a lower potential, are shifted inward with respect to the central axes of said two outer beams among said three electron beams.

13. An inline electron gun for a color picture tube according to claim 1, wherein the cross-section of each of said electrodes has a shape of a running track formed so that end points of two arcs opposite to each other in said first direction are connected by two parallel lines parallel to said first plane and opposite to each other in said second direction.

14. An inline electron gun for a color picture tube according to claim 1, wherein said electrodes are substantially hollow over the entirety of an intermediate region between opposite extreme ends of sad electrodes along the central axes of said electron beams except regions in the vicinity of said extreme ends.

15. An inline electron gun for a color picture tube according to claim 1, wherein the cross-section of each of said electrodes has a shape of a running track formed so that end points of two arcs opposite to each other in said first direction are connected by two parallel lines parallel to said first plane and opposite to each other in said second direction, and said electrodes are substantially hollow over the entirety of an intermediate region between opposite extreme ends of said electrodes along the central axes of said electron beams except regions in the vicinity of said extreme ends.

16. An inline gun for a color picture tube which generates a plurality of electron beams and directs them towards a fluorescent screen, comprising a main electrostatic lens for focusing said electron beams, said main electrostatic lens including a plurality of non-circular cylindrical electrodes which are adjacent to each other and each of which has a cross-section such that the inner dimension in a first direction which is in a first plane containing the central axis of said electron beams and is perpendicular to the central axes of said electron beams, is greater than the inner dimension in a second direction which is in a second plane perpendicular to said first plane and is perpendicular to said first direction, said electrodes having respective peripheral rims which oppose each other, the peripheral rim of at least one of said electrodes having such an uneven shape that a focusing force for the electron beams is increased in said first direction, the other of the electrodes adjacent to said at least one electrode being so formed that it covers at least the peripheral rim of said at least one electrode.

17. An inline electron gun for a color picture tube according to claim 16, wherein the number of said electrodes is three and the respective peripheral rims of the two electrodes, which are at both the ends, have said uneven shape, on the other hand the other electrode being so formed that it covers at least the peripheral rims of said two electrodes.

18. An inline electron gun for a color picture tube according to claim 16, wherein the peripheral rim of one of said electrodes, which is to be at a lower potential, has said uneven shape formed of concave parts disposed at the intersections of said peripheral rim and a plane which is perpendicular to said first plane and passes through the central axis of one of said electron beams which is at the center thereamong.

19. An inline electron fun for a color picture tube according to claim 16, wherein the peripheral rim of one of said electrodes, which is to be at a higher potential, has said uneven shape formed of convex parts disposed at the intersections of said peripheral rim and a plane which is perpendicular to said first plane and passes through the central axis of one of said electron beams which is at the center thereamong.

20. An inline gun for a color picture tube according to claim 16, wherein the number of said electron beams is three and protrusions are formed at middle portions between two adjacent ones among three points at which the peripheral rim of said at least one electrode intersect three planes which are perpendicular to said first plane and pass through the central axes of said three electron beams.

21. An inline electron gun for a color picture tube according to claim 16, wherein the number of said electron beams is three and protrusions are formed at locations retreated with a certain distance the interior of said at least one electrode from middle portions between two adjacent ones among three points at which the peripheral rim of said at least one electrode intersect three planes which are perpendicular to said first plane and pass through the central axes of said three electron beams.

22. An inline electron gun for a color picture tube according to claim 20, wherein the contour of each of said protrusions includes two arcs of two circles whose centers are on the central axes of two adjacent electron beams.

23. An inline electron gun for a color picture tube according to claim 16, wherein the outermost portions of said peripheral rims of said electrodes protrude for one of said electrodes, which is to be at a lower potential, and retreat for the other of said electrodes, which is to be at a higher potential, at a slope.

24. An inline electron gun for a color picture tube according to claim 16, wherein the outermost portions of the peripheral rims of said electrodes opposite to each other in said first direction are semicircular.

25. An inline electron gun for a color picture tube according to claim 24 wherein the number of said electron beams is three and the central axes of the lenses formed at both the sides of one of said electrodes, which is to be at a lower potential, are shifted inward with respect to the central axes of said two outer beams among said three electron beams.

26. An inline electron gun for a color picture tube according to claim 24, wherein the number of said electron beams is three and the central axes of the lenses formed at both the sides of one of said electrodes, which is to be at a higher potential, are shifted outward with respect to the central axes of the two outer beams among said three electron beams.

27. An inline electron gun for a color picture tube according to claim 26, wherein the central axes of the lenses formed at both the sides of one of said electrodes, which is to be at a lower potential, are shifted inward with respect to the central axes of said two outer beams among said three electron beams.

28. An inline electron gun for a color picture tube according to claim 11, wherein the cross-section of each of said electrodes has a shape of a running track formed so that end points of two arcs opposite to each other in said first direction are connected by two parallel lines parallel to said first plane and opposite to each other in said second direction.

29. An inline electron gun for a color picture tube according to claim 16, wherein said electrodes are substantially hollow over the entirety of an intermediate region between opposite extreme ends of said electrodes along the central axes of said electron beams except regions in the vicinity of said extreme ends.

30. An inline electron gun for a color picture tube according to claim 16, wherein the cross-section of each of said electrodes has a shape of a running track formed so that end portions of two arcs opposite to each other in said first direction are connected by two parallel lines parallel to said first plane and opposite to each other in said second direction, and said electrodes are substantially hollow over the entirety of an intermediate region between opposite extreme ends of said electrodes along the central axes of said electron beams except regions in the vicinity of said extreme ends.

31. An electron gun for an electron tube which generates a single electron beam and directs it towards a fluorescent screen, comprising a main electrostatic lens for focusing said electron beam, said main electrostatic lens including a plurality of non-circular cylindrical electrodes which are spaced apart with a certain distance to each other and each of which has a cross-section such that the inner dimension in a horizontal direction which is in a horizontal plane containing the central axis of said electron beam and is perpendicular to the central axis of said electron beam is greater than the inner dimension in a vertical direction which is a vertical plane perpendicular to said horizontal plane and is perpendicular to said horizontal direction, said electrodes having a peripheral rim, at least one of said peripheral rims having such an uneven shape that a focusing force for the electron beam is increased in said horizontal direction.

32. An electron gun for an electron tube according to claim 31, wherein the cross-section of each of said electrodes has a shape of a running track formed so that end points of two arcs opposite to each other in said first direction are connected by two parallel lines parallel to said horizontal plane and opposite to each other in said vertical direction.

33. An electron gun for an electron tube according to claim 31, wherein said electrodes are substantially hollow over the entirety of an intermediate region between opposite extreme ends of said electrodes along the central axis of said electron beam except regions in the vicinity of said extreme ends.

34. An electron gun for an electron tube according to claim 31, wherein the cross-section of each of said electrodes has a shape of a running track formed so that end points of said two arcs opposite to each other in said first direction are connected by two parallel lines parallel to said horizontal plane and opposite to each other in said vertical direction, and said electrodes are substantially hollow over the entirety of an intermediate region between opposite extreme ends of said electrodes along the central axis of said electron beam except regions in the vicinity of said extreme ends.

* * * * *